United States Patent [19]

Held

[11] 4,368,660

[45] Jan. 18, 1983

[54] PROTECTIVE ARRANGEMENT AGAINST PROJECTILES, PARTICULARLY HOLLOW EXPLOSIVE CHARGE PROJECTILES

[75] Inventor: Manfred Held, Kühbach, Fed. Rep. of Germany

[73] Assignee: Messerschmitt-Bölkow-Blohm Gesellschaft mit beschrankter Haftung, Munich, Fed. Rep. of Germany

[21] Appl. No.: 129,237

[22] Filed: Mar. 11, 1980

Related U.S. Application Data

[63] Continuation-in-part of Ser. No. 951,085, Oct. 13, 1978, abandoned, which is a continuation of Ser. No. 842,177, Oct. 14, 1977, abandoned, which is a continuation of Ser. No. 706,067, Jul. 9, 1976, abandoned, which is a continuation of Ser. No. 495,834, Aug. 6, 1974, abandoned.

[51] Int. Cl.[3] ..... F41H 5/04

[52] U.S. Cl. ..... 89/36 AE; 109/36; 109/84; 428/911

[58] Field of Search ..... 89/36 R, 36 A, 36 AE; 114/12; 428/911; 109/29, 36, 37, 80, 82, 84

[56] References Cited

U.S. PATENT DOCUMENTS

| | | | |
|---|---|---|---|
| 95,059 | 9/1869 | White | 109/37 |
| 469,971 | 3/1892 | Martin | 89/36 AE |
| 952,877 | 3/1910 | Copwer-Coles | 89/36 A |
| 1,225,461 | 5/1917 | McCarthy | 109/37 |
| 1,548,441 | 8/1925 | Branovich | 89/36 A |
| 2,391,353 | 12/1945 | Sheridan | 89/36 A |

FOREIGN PATENT DOCUMENTS

| | | | |
|---|---|---|---|
| 203908 | 6/1959 | Austria | 89/36 AE |
| 2031658 | 5/1972 | Fed. Rep. of Germany | 89/36 AE |
| 2053345 | 2/1977 | Fed. Rep. of Germany | 89/36 AE |

OTHER PUBLICATIONS

S. Fordham, High Explosives and Propellants, 1980, pp. 164–166.

*Primary Examiner*—Stephen C. Bentley
*Attorney, Agent, or Firm*—Toren, McGeady and Stanger

[57] ABSTRACT

A protective arrangement against projectiles is a wall structure formed from a wall layer of explosive material, and at least one additional wall layer covering at least one face of the wall layer of explosive material. The additional wall layer is made of a non-explosive, inert high-density material such as metal. In one embodiment both faces of the explosive wall layer are covered with a layer of inert, non-explosive high-density material such as metal. The protective arrangement is particularly suitable for protection against the destructive force of hollow explosive charge projectiles.

12 Claims, 2 Drawing Figures

PROTECTIVE ARRANGEMENT AGAINST PROJECTILES, PARTICULARLY HOLLOW EXPLOSIVE CHARGE PROJECTILES

CROSS REFERENCE TO RELATED APPLICATIONS

This is a continuation-in-part of application Ser. No. 951,085 filed Oct. 13, 1978, now abandoned, which was a continuation of application Ser. No. 842,177 filed on Oct. 14, 1977, now abandoned, which was a continuation of application Ser. No. 706,067 filed July 9, 1976, now abandoned, which, in turn, was a continuation application of application Ser. No. 495,834 filed Aug. 6, 1974, now abandoned.

FIELD OF INVENTION

The invention is directed to protective arrangements against projectiles, particularly so-called hollow explosive charge projectiles.

BACKGROUND INFORMATION AND PRIOR ART

It has previously been proposed to provide a protective arrangement against the destructive force of projectiles, including hollow explosive charge projectiles. According to this prior art proposal, explosive charges are accommodated in a series of interconnected or communicating hollow bodies which are arranged adjacent or on a base plate which may constitute the very surface to be protected. These explosive charge-containing bodies are thus arranged in the immediate vicinity of the base plate. The hollow bodies referred to, and which contain the explosive charges, are formed by two, intersecting ribbed strip-like members and resistant, relatively thick-walled plates which constitute those boundaries of the hollow bodies which face away from the base plate. At the broad sides of these thick-walled plates which face the explosive charges, fuse or detonator needles or pins are arranged, which extend perpendicular to the plates. The plates are connected to the associated, adjacent ribbed sections by screwing or the like with the interposition of flexible or elastic seals or packing. Upon the impact of a projectile on the associated, resistant plate and due to the yieldable construction of the seals, each of these fuse needles moves together with the plate in the direction toward the associated explosive charge. The explosive charge is then caused to detonate when contact is established. The result of such a detonation is a movement of the respective resistant plates in a direction away from the base plate in order to counteract and minimize the damaging projectile effect on the base plate, the base plate—as mentioned above—usually or sometimes constituting the surface to be protected.

The prior art arrangement briefly described above has numerous disadvantages and drawbacks, some of which are of a serious nature. These drawbacks and disadvantages may be enumerated as follows: firstly, the arrangement is relatively complicated and cumbersome. In view thereof, experience has indicated that the construction oftentimes malfunctions and no detonation of the explosive charges take place. Further, due to the complexity of the arrangement, the production costs are relatively high. Moreover the prior art arrangement is bulky, space-consuming and relatively heavy, disadvantages which are particularly detrimental if the objects to be protected are vehicles, since the bulkiness and weight of the protective arrangement significantly and negatively influences the maneuverability of the vehicles. It should also be considered that due to the particular construction and arrangement of the resistant plates, the ribbed members, the packing or seals between these structural members and the detonator or fuse needles, detonation of the associated explosive charges most frequently fails to take place when the projectiles strike the resistant plates in an oblique or slanted manner. In this context it should be appreciated that, in practice, projectiles customarily and most frequently impinge onto the resistant plates in an angular manner and not in a direction which extends exactly perpendicular to the surface of the plates. The prior art arrangement is particularly unsuitable for such oblique impact of the projectiles. This is so because that component of the impact or shock force which is effective in the direction of the fuse or detonator needle or pin is no longer sufficient in order to move the fuse or detonator needle into the required contact with the associated explosive charge of the protective arrangement. However, even when the impact of the projectile is exactly perpendicular or approximately perpendicular to one of the resistant plate surfaces, the prior art protective arrangement, which is usually referred to as a "dynamic protective arrangement" does not offer sufficient protection if the impinging projectile is of the hollow explosive charge type. Such hollow explosive charge projectiles are, however, used predominantly in modern warfare due to their superior penetrating effect against strongly armored objectives. The prior art protective arrangement is unsuitable to protect against such hollow explosive charge projectiles because, as is known, at the instant of impact of the projectile and due to the detonation of the hollow explosive charge released thereby, an energy-rich thorn or jet is formed from the lining material of the hollow explosive charge. This thorn which travels along a path toward the base plate will have penetrated the resistant plate of the prior art protective arrangement long before such plate—under the pressure effect of the detonated explosive charge of the protective device—starts its counter directed movement. In this connection it should be appreciated that the velocity of the thorn is several thousand meters per second while by contrast the movement of the plate which is caused by the pressure resulting from the detonation of the explosive charge is relatively slow. Thus the intended barrier formed by the protective arrangement is, from a practical point of view, not effective at all, since the barrier is penetrated by the thorn before any effective counter measures can be taken. It follows that the prior art protective arrangement does not in fact form an effective defense or protection against projectiles of this kind.

SUMMARY OF THE INVENTION

It is the primary object of the present invention to overcome the disadvantages and drawbacks of the prior art protective arrangement and to provide a protective arrangement which is superiorly effective against all kinds of projectiles including hollow explosive charge projectiles.

It is also an object of the present invention to provide a protective arrangement of the indicated kind which is relatively inexpensive to manufacture, is reliable, not bulky and relatively light.

It is also an object of the invention to provide a protective arrangement of the indicated kind which has an exceedingly simple structural composition and can be readily assembled and installed.

Briefly and in accordance with the invention, the protective arrangement comprises a wall structure which has the explosive wall layer being covered by a wall layer of inert material. The term "inert" as used herein is deemed to refer to a non-explosive material which does not react with itself or with other materials. Such inert materials are most of the metals, plastics and natural substances, such as, for example, wood. For the purposes of this invention, it is of particular advantage to use an "inert" wall layer in which the inert material is made of steel or simply iron. The latter metal is suitable if cost is of the essence and an average density value is sufficient. However, if the emphasis is on light weight constructions, then the non-explosive "inert" wall layer may be made of or consist of aluminum or plastics. For military purposes, heavy metals, such as copper, can be suitably used. Such metals, of course, are more expensive, but due to their high specific weight they assure a more intensively destructive influence on the thorn. In one embodiment of the invention both faces of the explosive wall layer are covered with an inert wall layer.

A large variety of explosive materials may be used for the explosive wall layer. The following examples are given by way of illustration but not by way of limitation:

Hydrogen, octogen, nitropenta, tentryl, TNT or mixtures of such explosives.

Such a mixture, for example, is the known "Composition B" which consists of 60% by weight of hexogen, 39% by weight of TNT and 1% by weight of wax. Another suitable explosive mixture consists of 90% by weight of nitropenta and 10% by weight of wax.

For weight reasons, it is within the scope of this invention to dimension the entire wall structure in an exceedingly thin manner of, for example, only about 0.5 mm. If an extremely thin protective wall structure is to be constructed, the explosive layer is advantageously made of nitropenta having a grain size of below 100 μmm. For example, if an armored vehicle having a total surface of 20–30 square meters is to be protected by the protective arrangement of the invention, the wall structure is applied to the exterior surfaces of the vehicle or the wall structure is applied in the manner of roofing tiles to the walls of the vehicle. If the protective arrangement has a thickness of about 0.5 mm, then the total protective arrangement with the dimensions previously mentioned and with an average specific weight of the protective arrangement of, for example, 6 (30 m2×6×0.0005) three layers being applied=0.27 ton=270 kg. It follows that it is suitable to keep the protective structures very thin in order not unduly to increase the weight of the armored vehicles and thus to have to reduce the military load which the vehicle can carry.

In addition to its exceedingly simple construction, the inventive protective arrangement is distinguished by its light-weight and compact construction as differentiated from the heavy, bulky constructions of the prior art arrangements. Further, and as will be demonstrated hereinbelow, the inventive protective arrangement is exceedingly effective against projectiles which impinge on the protective device in an oblique manner, even if the projectile is of the hollow explosive charge type. This is clearly in contrast to the inferior protective effect of the prior art arrangements which are essentially useless for protecting against hollow explosive charge projectiles impinging in oblique manner.

As previously stated, it is well recognized that in hollow explosive charge projectiles the detonation of the lined hollow charge results in the instantaneous formation of an extremely energy-rich thorn or jet member. This thorn is capable of penetrating into or through steel plates for a distance which is six to eight times as large as the base diameter of the hollow explosive charge lining. This applies also to steel plates of great tensile strength. This extremely high penetration effect of the hollow explosive charge thorn is generally attributed by the experts in this field to the extremely high peak speeds of the thorn which oftentimes reach values of several thousand meters per second. These peak speeds in turn result in the generation of very high pressure heads in the target material which in turn cause the target material to be displaced away from the thorn axis without consideration of the strength characteristics of the target material. If the point of such a highly energetic thorn impinges on the wall layer of explosive material of the inventive arrangement, the impact force causes detonation of the explosive wall layer. This detonation effect will somewhat interfere with the point of the thorn in maintaining its original travel direction. However, this detonation effect, taken alone, is not sufficient in order to cause a significant performance loss or loss in effect of the entire thorn. Such loss, however, is caused by the additional wall layer of non-explosive material which is provided on at least one of the faces of the explosive material wall layer. Thus when the explosive wall layer detonates, the additional, non-explosive, inert wall layer is caused to move away in a direction perpendicular or approximately perpendicular to the explosive wall layer. This additional inert wall layer, dependent on whether it is provided on the front or rear face of the explosive wall layer, thus moves opposite to or in the same direction as the thorn. The movement of this additional wall layer is, in respect of its speed, dependent both on the composition and thickness of the explosive wall layer and also on the composition and thickness of the inert wall material. This inert wall movement—particularly if the normal of the wall structure includes with the longitudinal axis of the impinging projectile or thorn an angle of at least 30°, preferably 45° to 70°—makes sure that continuously fresh inert wall material is moved into the path of travel of the thorn with sufficient speed. The positive consequence, of course, is that the thorn is rapidly spent or consumed at the areas where this fresh wall material cuts into the thorn. These cutting areas on the thorn thus constantly change in respect to the longitudinal extension of the thorn. The consumption of the thorn is, of course, particularly effective and rapid if the inert wall material has a relatively high density.

As previously stated, in one embodiment of the invention, both the front face and the rear face of the wall layer of explosive material are covered with wall layers of inert material. The inert wall layers are advantageously made of material of high density. The use of high density wall layers to cover the wall layer of explosive material has the following advantage: when the explosive wall layer is detonated, the inert wall layer which covers the front face of the explosive wall layer will be moved in a direction opposite to that of the thorn while the inert wall layer which covers the rear face of the explosive wall layer moves in the same direction as the thorn. This means that if a situation should occur in which the amount of inert material of the front wall layer which comes into impeding or cutting contact with the thorn is insufficient to neutralize the penetrating action of the thorn, so that the thorn reaches the rear wall layer of inert material, the amount of inert material of this rear wall layer which comes into cutting contact with the thorn will be sufficient to cut up or consume the thorn. This is particularly so since this rear wall layer moves in the same direction as the thorn and thus the material of this rear wall layer repeatedly intersects the thorn path and thus cuts up and spends the thorn. Experiments have indicated that this constructively very simple wall structure, effectively minimizes the penetrating effect of the thorn. Thus it has been found that in many instances the original penetration effect is reduced to one-twentieth.

According to a further feature of the invention, the explosive material used for the explosive wall layer should be of the kind which is relatively insensitive to detonation and is capable of detonation at shockwave pressures of at least ten kilobar only and which have or can reach detonation velocities of at least 2,000 meters per second. Explosive materials which exhibit such characteristics are preferred for the inventive purposes because premature, unintentional and thus undesired explosion of the explosive wall layer is effectively prevented. Further, the inventive protective arrangement which makes use of such explosive materials will then, of course, not respond, that is the explosive wall layer will not be detonated, if projectiles impinge on the arrangement which have insufficient impact or penetration force to cause the detonation of the explosive wall layer. Thus, for example, if the protective arrangement should be subject to small arms fire and the impinging projectiles do not cause the required shockwave pressure values, no explosion of the explosive wall layer will take place. In other words if the inventive protective arrangement is fired upon with ammunition which is not capable of penetrating conventional armor, the detonation of such ammunition will be sufficiently neutralized by the covering lateral wall layer or wall layers of inert material. The protective effect of the wall structure against such relatively innocuous ammunition is thus sufficient to reduce the speed of the projectile or thorn to a value at which no detonation of the explosive wall layer takes place.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
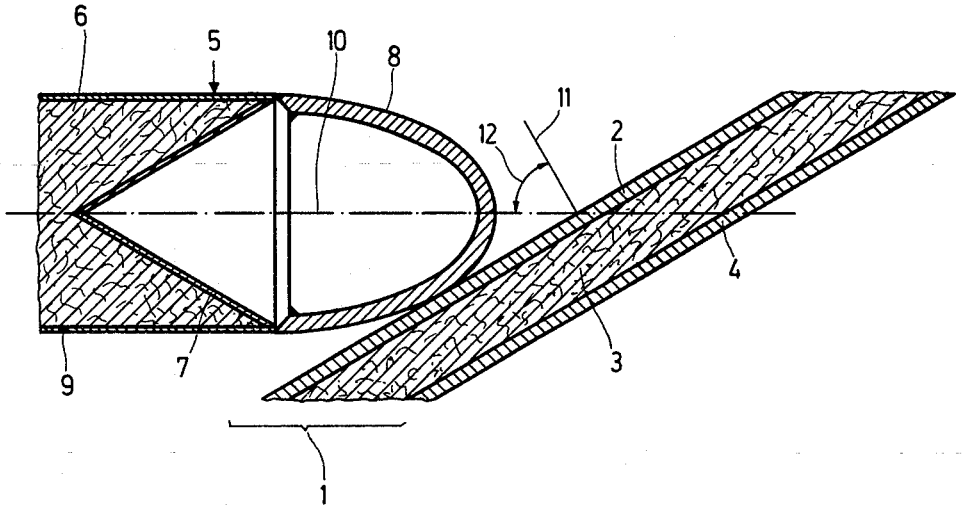
FIG. 1 is a fragmentary sectional view of a protective arrangement embodying the invention and indicating a hollow explosive charge projectile just prior to impact on the inventive protective arrangement.
Figure 2:
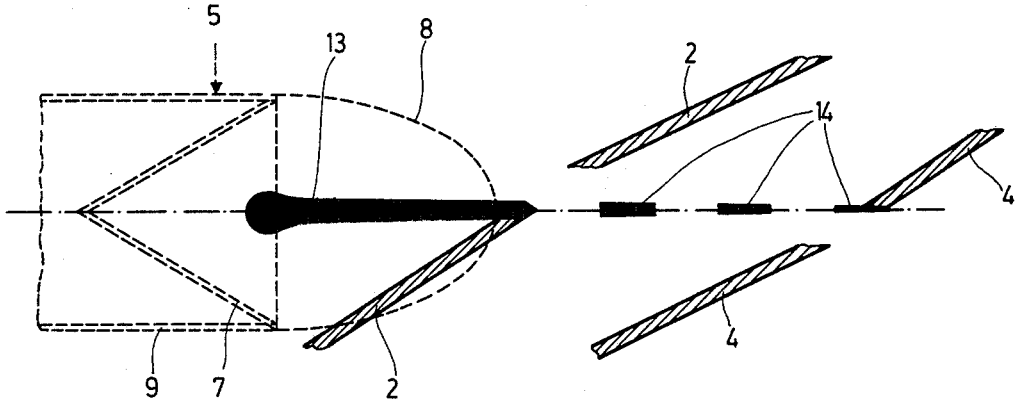
FIG. 2 is a view corresponding to FIG. 1, however, indicating the conditions after the detonation of the explosive wall layer of the wall structure caused by the impact of the projectile.

The wall structure of the inventive protective arrangement of FIGS. 1 and 2 is generally indicated by reference numeral 1 and is depicted as a cross-sectional fragment. The wall structure consists of three wall layers which are united without spacing to form the structural unit 1. The wall structure unit 1 thus comprises layers 2, 3 and 4. The central layer 3 consists of an explosive material of the kind which detonates at shockwave pressures of about ten to 200 kilobar and which has detonation speeds of at least 2,000 meters per second. Wall layer 2, hereinafter referred to as the front wall layer, is made of non-explosive inert material of high density, for example a suitable metal. Wall layer 4, hereinafter referred to as the rear wall layer, is also made of inert, high density material such as metal and may be made of the same material as wall layer 2. As shown in FIG. 1, wall layers 2 and 4 thus sandwich and contact the opposite faces of the wall layer 3 of explosive material.

As stated above, a large variety of inert material, such as metals, plastics and material substances, can be used for the layers 2 and/or 4. This includes materials of high density and, for example, copper. Though natural materials, such as wood, have a low density, that is, a density below 1, they are also suitable. It will be appreciated that materials with high densities are more favorable if considered from the viewpoint of military effectiveness because the destruction or at least the destructive influence on the hollow charge thorn is more intense by a heavy metal. This would appear to be obvious. However, this individual specific effectiveness of a material of high density is negated by the substantially higher weight of such materials. For this reason, compromise solutions are oftentimes resorted to in which the high destructive effect of a high density material is compromised with a less expensive lower density material. A protective wall structure including or made of plastics material may be advantageous considering the light weight of such structures.

A wide variety of explosive material may be used for the wall layer 3. As mentioned above, some of the explosive materials which may be used are hexogen, octogen, nitropenta, tetryl, TNT or mixtures of these materials.

The individual layers of the protective wall structure may be adhesively connected to each other. However, there are other ways of forming the protective wall structure. Thus, for example, and referring to FIG. 1 of the drawings, the explosive layer 3 may be applied to an inert layer 2 in liquid condition, and a second inert layer 4 is subsequently applied on the other side of the explosive layer 3. Upon solidification, the three layers are rigidly connected to each other to form the uniform wall structure. Another possibility is to place the three layers in solid condition one upon the other and then to insert the superimposed structure into a heating furnace at a temperature which is slightly above the melting temperature of the explosive material so that the three layers fuse to form the uniform structure. A still further possibility is to cast the explosive layer 3 between the two inert layers 2 and 4 in a suitable mold.

The drawings, in addition to the inventive protective structure, also shows a projectile of the hollow explosive charge kind generally indicated by reference numeral 5. In FIG. 1 the projectile 5 is shown at the instant of impact with the front metal layer 2 just prior to detonation of the hollow explosive charge 6 of the projectile 5. By contrast, in FIG. 2 the projectile 5 is shown after the detonation of its hollow explosive charge 6 which, in turn, resulted in the detonation of the explosive wall layer 3 of the protective arrangement 1. The projectile 5 is of well-known construction and consists, in addition to the mentioned hollow explosive charge 6, of a lined recessed portion 7, a contact hood 8 which serves as a spacer and a casing or projectile sleeve 9 which combines and holds together the members 6, 7 and 8 as a single unit. The angle which the projectile longitudinal axis 10 includes, at the instant of impact with the normal 11 of the front metal layer 2, is indicated by reference numeral 12 and amounts in the present example to about 60 degrees. As previously stated, projectiles customarily strike at an oblique angle relative to the impact surface.

The mode of operation or effect of the projective arrangement of FIGS. 1 and 2 is as follows: at the instant of impact of the hollow explosive charge projectile 5 on the front metal layer 2, the hollow charge 6 is detonated by means of an igniting mechanism (not shown) which does not pertain to the invention and is well-known in the art. Accordingly this igniting mechanism has not been shown or described. The detonation of the projectile 5 causes the formation of a highly energetic thorn or jet which is formed by the lining material 7 of the projectile 5, the thorn being indicated by reference numeral 13. The formation of such thorns or pointed penetration members is well-known in the art. The point of this thorn 13 impinges with a speed of 2,000 to 12,000 meters per second on the explosive wall layer 3 of the protective arrangement and thus causes this explosive wall layer to detonate. The explosive wall layer is composed in such a manner that thorn speeds of at least 1,000 meters per second are required to cause detonation. The detonation of the explosive wall layer 3, slightly interferes with the point of the thorn 13 without, however, seriously interferring with the travel of the thorn. The detonation pressure caused by the detonation, in turn, sets into motion the front wall layer 2 and the rear wall layer 4. These wall layers 2 and 4 are thus moved perpendicular or almost perpendicular relative to the surface of the detonated explosive wall layer 3, the front wall layer 2 moving in a direction opposite to the direction of the thorn 13 while the rear wall layer 4 moves in the same general direction as the thorn 13. Due to these movements of the wall layers 2 and 4 which in the present embodiment consist of an inert high density metal, new metal material is continuously moved into the path of the high speed thorn 13 thus causing consumption or cutting up of the thorn at the areas of intersection with the inert material. The speed of movement of the wall layers 2 and 4 is dependent on the nature and quantity of the explosive material in the explosive wall layer 3 and also on the nature and quantity of the inert material of the wall layers 2 and 4. Dependent on these factors, the wall layers 2 and 4 move with speeds of, for example, 500 to 2,000 meters per second, speeds which thus are sufficient to cause continuously new inert metal material to come into contact with portions of the thorn 13, thereby consuming or destroying the thorn. Any thorn remnants, indicated by reference numberal 14, which penetrate through the front wall layer 2 and continue to move toward the rear wall layer 4 are effectively absorbed and cut up by the moving rear wall layer 4 which, as stated, moves in an opposite direction.

A distinction should be made between the inherent detonation velocity of at least 2000 m per second of the explosive layer 3 and the initiating velocity of this layer. The explosive layer 3, in order to be initiated or activated, requires thorn speeds of at least 1000 m per second. As previously indicated, the point of the hollow charge thorn penetrates, for example, with a penetration speed of 2000 m per second. Of course, it could also happen that the point of the thorn penetrates at a higher speed. This, of course, would be sufficient to initiate the explosive action of the layer 3 which, however, in such a case would then detonate at a higher speed.

The wall structure unit 1 shown in the drawing finds particular use or application for the protection of armored land vehicles. However, it is also within the scope of this invention to use the proposed protective arrangement on sea-going vehicles, such as ships, and also for aircraft. Thus, for example, the protective arrangement may be used for the protection of gun emplacements, certain particularly sensitive areas of ships and aircraft, cell walls and the like. Moreover, the protective arrangement can be suitably used for stationary installations. The walls of rockets or other flying bodies should also be mentioned. It is thus feasible to construct the walls of rockets of protective wall structures of the invention.

While a specific embodiment of the invention has been shown and described in detail to illustrate the application of the inventive principles, it will be understood that the invention may be embodied otherwise without departing from such principles.

I claim:

1. A protective arrangement against projectiles, for covering the surfaces of vehicles such as land vehicles like tanks, flying vehicles like aircraft and sea-going vehicles like ships and of stationary installations where the protective arrangement covers surfaces of the vehicle or stationary installation exposed to attack by projectiles, comprising a continuous wall structure, said wall structure having a continuous first wall layer of explosive material with oppositely directed faces and a first and a second additional continuous layer each covering and in surface contact with one of the faces of said wall layer with said first additional continuous layer facing in the direction from which a projectile usually impacts against said wall structure and said second additional continuous layer facing in the direction opposite to the direction in which said first additional continuous layer faces, each of said first and second additional wall layers is formed of an inert non-explosive material and has a first surface directed outwardly from said first wall layer with said face surface extending obliquely to the usual impact direction of a projectile against said wall structure, said first wall layer of explosive material detonating only at shock wave pressures exceeding a given level so that said first wall layer does not detonate when exposed to small arms fire and similar sources of shock wave pressure, and when said first wall layer detonates said first and second additional wall layers move away from said first wall layer in a direction perpendicular or approximately perpendicular to said first wall layer.

2. A protective arrangement, as set forth in claim 1, wherein each of said inert first and second additional wall layers is relatively thin.

3. A protective arrangement, as set forth in claim 1, wherein each of said first and second additional wall layers consists of a metal.

4. A protective arrangement, as set forth in claim 1, wherein each of said first and second additional wall layers consists of a high density metal having a density at least equal to that of copper.

5. A protective arrangement, as set forth in claim 1, wherein each of said first and second additional wall layers is formed of a plastics material.

6. A protective arrangement, as set forth in claim 1, wherein each of said first and second additional layers is formed of wood.

7. A protective arrangement, as set forth in claim 1, wherein said explosive material of said first wall layer detonates only at shock wave pressures of at least 10 kilobar and reaches detonation speeds of at least 2,000 meters per second.

8. A protective arrangement against projectiles, comprising a continuous three-layer wall structure, said three-layer wall structure consisting of a continuous intermediate wall layer of explosive material detonating only at shock wave pressures of at least 10 kilobar and achieving detonation speeds of at least 2,000 meters per second, said intermediate layer sandwiched between and in surface contact with continuous second and third layers of a thin metallic material, and when said first wall layer detonates said continuous second and third layers move away from said first wall layer in a direction perpendicular or approximately perpendicular to said first wall layer.

9. A protective arrangement against projectiles, as set forth in claim 8, wherein said second and third layers are formed of a high density metal having a density at least equal to that of copper.

10. A protective arrangement against projectiles, as set forth in claim 8, wherein said three-layer wall structure has a total thickness in the range of 0.5 mm.

11. A protective arrangement against projectiles, comprising a continuous wall structure, said wall structure including a continuous first wall layer of explosive material relatively insensitive to detonation and requiring a projectile impact at a velocity of 1,000 meters per second for detonating the explosive material, and continuous second and third wall layers each covering and disposed in surface contact with one of the faces of said first wall layer with said second wall layer facing in the direction from which a projectile usually impacts and said third wall layer facing in the opposite direction, said second and third wall layers are formed of an inert, non-explosive material, and when said first wall layer detonates said second and third wall layers move away from said first wall layer in a direction perpendicularly or approximately perpendicular to said first wall layer.

12. A protective arrangement against projectiles, as set forth in claim 11, wherein said first wall layer of explosive material is formed of one of the group consisting of hexagen, octogen, nitropenta, tetryl, TNT or a mixture of such explosives.

* * * * *